US007044617B2

(12) United States Patent
Maxwell et al.

(10) Patent No.: US 7,044,617 B2
(45) Date of Patent: May 16, 2006

(54) APPARATUS AND METHOD FOR MINIMIZING OR ELIMINATING SHADOWS IN DISPLAY DEVICES

(75) Inventors: Robert Clark Maxwell, deceased, late of Paradise, CA (US); by Kathy O. Maxwell, legal representative, Paradise, CA (US); David Dwayne Echeberry, Paradise, CA (US); Dennis Kenneth Rausch, Paradise, CA (US)

(73) Assignee: Monoceros Corporation, Paradise, CA (US)

( * ) Notice: Subject to any disclaimer, the term of this patent is extended or adjusted under 35 U.S.C. 154(b) by 198 days.

(21) Appl. No.: 10/722,322

(22) Filed: Nov. 24, 2003

(65) Prior Publication Data

US 2004/0184268 A1 Sep. 23, 2004

Related U.S. Application Data

(60) Provisional application No. 60/454,975, filed on Mar. 17, 2003.

(51) Int. Cl.
*F21S 33/00* (2006.01)

(52) U.S. Cl. ..... 362/145; 362/132; 362/253; 211/85.1

(58) Field of Classification Search ..... 362/145, 362/133, 125, 253, 132; 108/23, 108; 211/85.1; 206/902

See application file for complete search history.

(56) References Cited

U.S. PATENT DOCUMENTS

| | | | | |
|---|---|---|---|---|
| 3,694,945 | A * | 10/1972 | Detiker | 40/615 |
| 4,184,194 | A * | 1/1980 | Shofu | 362/97 |
| 5,758,585 | A * | 6/1998 | Latchinian | 108/23 |
| 6,041,948 | A * | 3/2000 | Filipak et al. | 211/85.1 |
| 6,443,317 | B1 * | 9/2002 | Brozak, Jr. | 211/85.1 |
| 6,625,913 | B1 * | 9/2003 | Prade | 40/738 |
| 6,662,503 | B1 * | 12/2003 | Cowell et al. | 52/35 |
| 6,915,914 | B1 * | 7/2005 | Farrand | 211/163 |
| 2003/0064814 | A1 * | 4/2003 | Stephan et al. | 463/46 |

OTHER PUBLICATIONS

Atofina Chemicals, Inc. brochure on Plexiglas Frosted Acrylic Sheet, date unknown, Atoglas Division, Philadelphia, PA. (ADV000761/APL:ATG-189/TGI/8-00).

Atofina Plexiglas MC Acrylic Sheeet Material Safety Data Sheet (6 pages) Oct. 9, 2000.

* cited by examiner

*Primary Examiner*—Ali Alavi
(74) *Attorney, Agent, or Firm*—William W. Bodnar

(57) ABSTRACT

A display device utilizes an acrylic sheet frosted throughout its structure and an opaque surface or panel. The acrylic sheet or panel is placed substantially parallel to the opaque surface or panel such that the acrylic sheet or panel and the opaque surface or panel are separated by a distance of between 1 and 185 millimeters (0.04 to 7.3 inches). Display items are mounted on item supports on the display side of the acrylic sheet or panel. Shadows cast by the display items or item supports on the acrylic sheet are absorbed by the acrylic sheet or panel due to the nature of the frosted acrylic material and spacing between the acrylic sheet or panel and the opaque background surface or panel

15 Claims, 11 Drawing Sheets

Effect of Opaque (Background) Panel Color and Plexiglas and Background Panel Separation on Shadow Strength

APPARATUS AND METHOD FOR MINIMIZING OR ELIMINATING SHADOWS IN DISPLAY DEVICES

CROSS REFERENCE TO RELATED APPLICATIONS

This application claims priority from U.S. Provisional Patent Application No. 60/454,975 filed Mar. 17, 2003. The contents of U.S. Provisional Patent Application No. 60/4554,975 are fully incorporated herein by reference.

BACKGROUND OF INVENTION

1. Field of Invention

This invention relates to display devices, specifically to ways to minimize the effect of shadows on display devices.

2. Objects and Advantages

In the display of items for retail or non-retail purposes, it is important that the item be displayed in such a way that it appears attractive. When merchandise is displayed, the sale is often dependent on the effectiveness of the display in keeping the viewer's focus on the merchandise. This is particularly true in the case of eyeglasses, whether they be corrective glasses or sunglasses, because there are a large number and variety of glasses to display at one time. With such a wide number of eyeglasses and styles displayed at once, it is important that the viewer be able to focus on the eyeglasses themselves with as little distraction as possible.

The display of sale items is best accomplished with illumination adequate to draw attention to the merchandise being offered, but such illumination often results in considerable shadows being cast by the merchandise itself and/or display devices being used to support the merchandise. As an example, when eyeglass frames are displayed on a panel illuminated by spot or flood lights, the eyeglass frames and the holders being used to support them typically cast numerous shadows against the background panel. These shadows are unsightly and distract attention from the merchandise.

It is therefore a primary object of the present invention to provide a display device that allows items to be displayed with minimum impact from shadows caused by the items or their placeholders or support means.

A further object of the invention is to provide a display device that is simple, lightweight, and rugged in construction, is inexpensive to manufacture from readily-available materials, and is capable of a long life of useful service with a minimum of maintenance.

3. Prior Art

In previous display devices, either artificial light of natural light was used to illuminate the display items. The problem was that the light illuminating the display items also cast noticeable shadows upon the display background. These shadows were caused by the display items or the item support holders blocking some portion of the light and thus creating shadows. The shadows decreased the effectiveness of the display by drawing attention away from the display items. This invention overcomes that flaw by utilizing a translucent panel property positioned apart from a background panel to "absorb" or diminish the shadows cast by the display items or their support/placeholders.

SUMMARY OF INVENTION

This invention relates to a device and method for the presentation of objects which minimizes the impact of shadows on the display. Display objects are attached upon or placed in front of a panel of translucent material. The panel of translucent material is affixed to or positioned in relation to an opaque panel or wall surface. The spacing between the translucent panel and the opaque panel or surface is critical to minimizing the impact of shadows cast by the display materials or supports onto the translucent panel. The display items can be illuminated by natural or artificial light.

BRIEF DESCRIPTION OF DRAWINGS

The character of the invention, however, may be best understood by reference to one of its structural forms, as illustrated by the accompanying drawings, in which.

DETAILED DESCRIPTION (OF THE PREFERRED EMBODIMENTS)

Figure 1A:
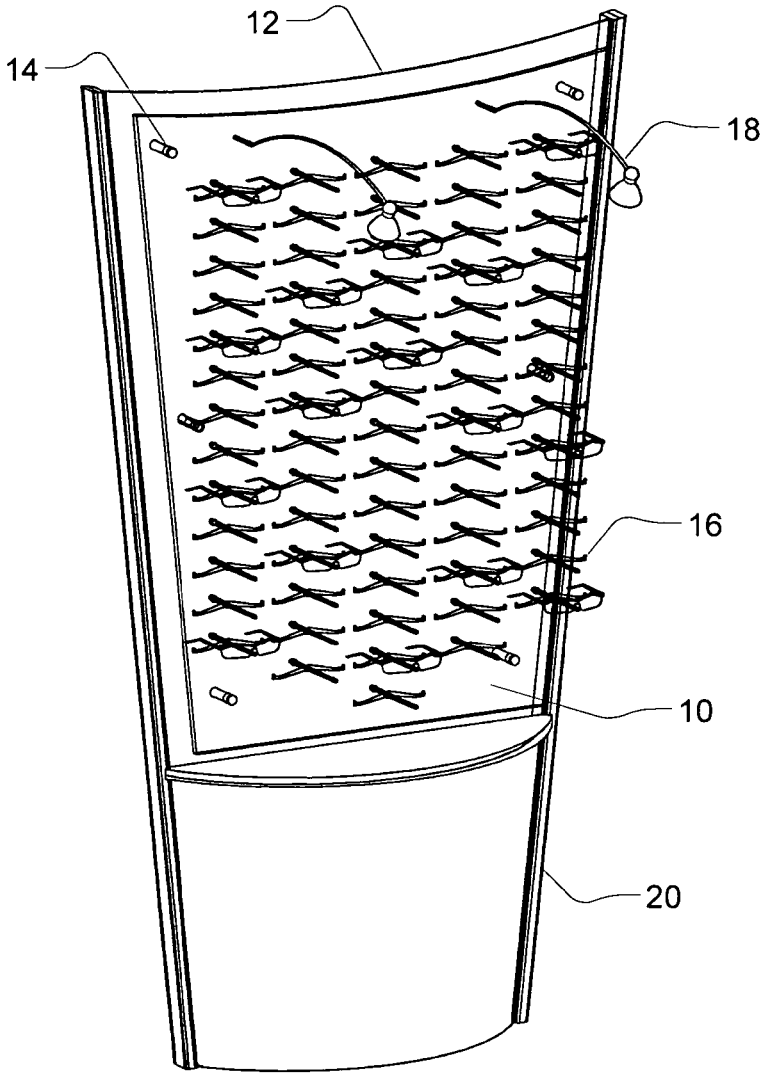
FIG. 1 is a perspective view of a display device incorporating the principles of the present invention and shown in use with multiple eyeglass frame supports.
Figure 1B:
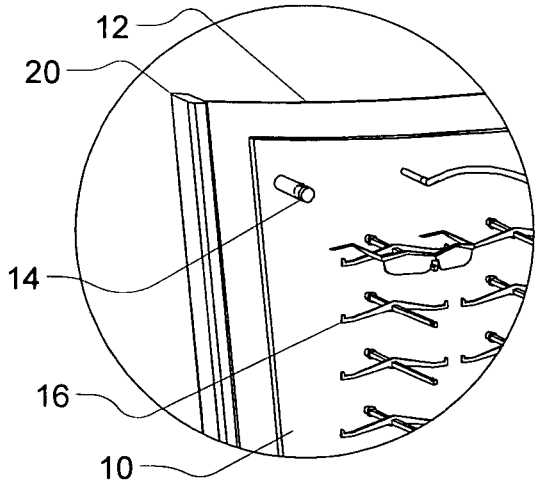

Referring to FIG. 1, which best shows the general features of one embodiment of the invention, a background panel 12 is part of a self-supporting display stand or framework 20.

The display device also includes a translucent panel, indicated generally by the reference numeral 10. The translucent panel is affixed to the background panel 12 so that a gap of between 1 and 185 mm separates the translucent panel 10 from the background panel 12. Stand-off mounts 14 are used to provide support for affixing the translucent panel to the background panel and establishing the distance between the two panels.

In this embodiment, overhead lighting 18 is provided as part of the display. Item supports 16 affixed to the translucent panel support eye frames as shown in FIG. 1. When light illuminates the display items, some of the light is blocked by the display item or the supports 16.

The inventors discovered that by using a translucent panel made of Plexiglas® and positioning the panel between 1 and 150 mm from the background panel, shadows cast on the Plexiglas panel were minimized and in some cases non-detectable to the naked eye. Spacing between the translucent panel and the background panel is critical.

Experimentation with different materials led the inventors to utilize a form of Plexiglas® for the translucent panel. This material was readily available from a commercial source and further minimized the effect of the shadows in relation to other materials.

The Plexiglas® used by the inventors is Plexiglas® Frosted Acrylic Sheet. It is manufactured by ATOFINA Chemicals, Inc. Plexiglas® Frosted Acrylic Sheet has the frosted look throughout the entire acrylic structure which makes it more effective than other "surface frosted" materials tested. There may be other sources of frosted Acrylic sheet available that are frosted throughout.

The thickness of the Frosted Acrylic Sheet tested was 0.236 inches (6 mm) and sheets are available in thickness ranging from 0.08 inches (2 mm) to 0.472 inches (12 mm).

The inventors discovered that the background panel should be opaque and that white surfaces achieved the best results in minimizing the effect of shadows (see quantification of results below).

Figure 2A:
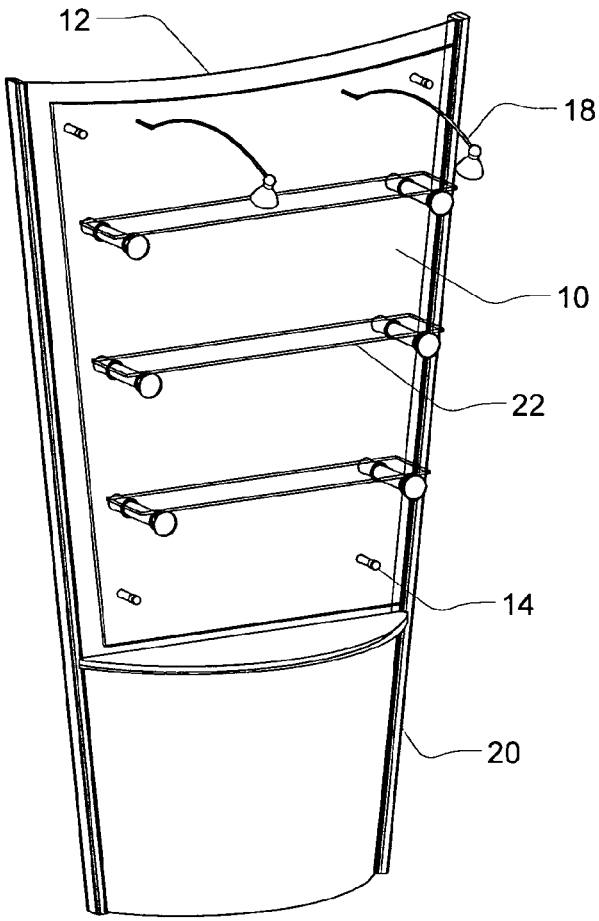
FIG. 2 is a perspective view of a display device with glass shelving to support the display items.
Figure 2B:
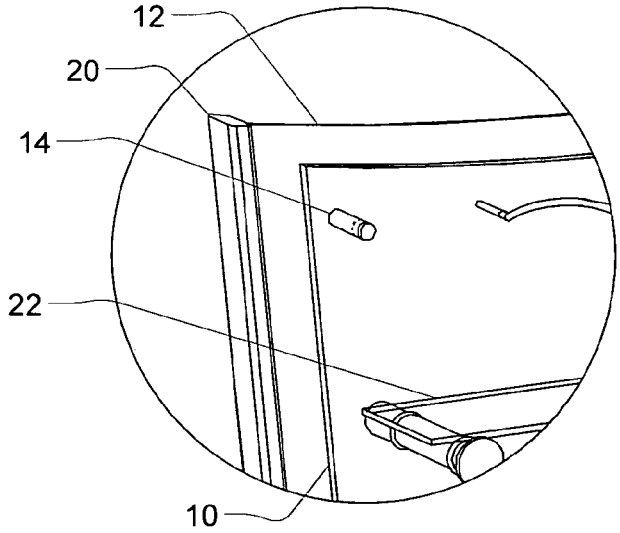

FIG. 2 shows another self-supporting display device similar to the FIG. 1 display device. In the FIG. 2 embodiment however, glass shelves are utilized to hold the display items. This embodiment also utilizes stand-off mounts 14 to affix the translucent panel to the background panel.

Figure 3A:
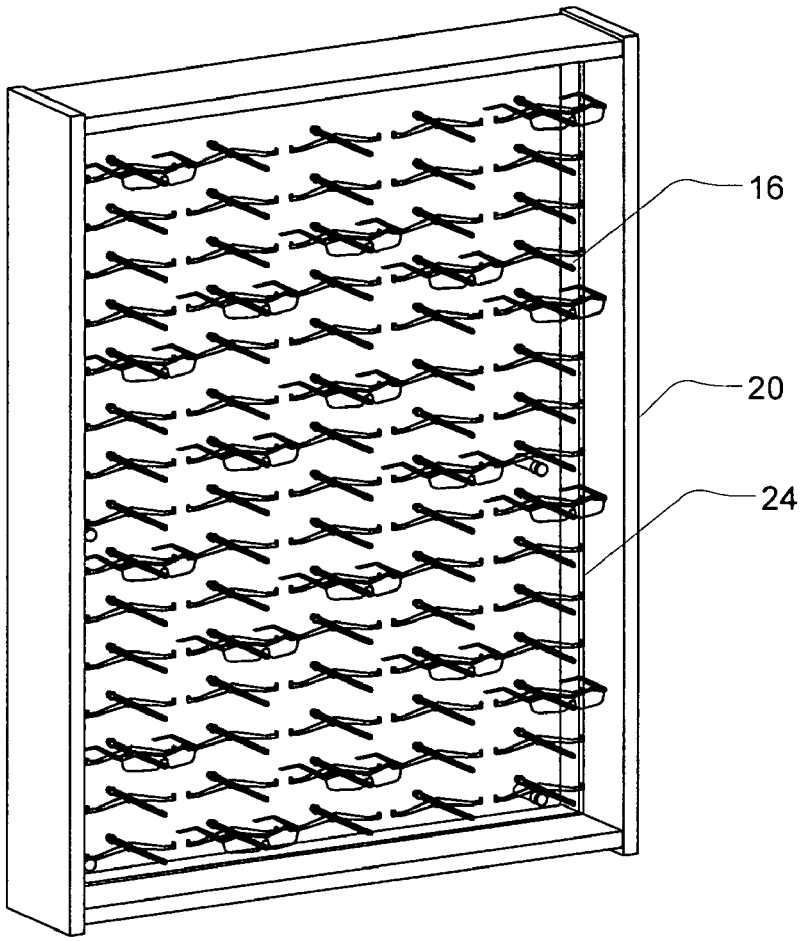
FIG. 3 is a perspective view of a display device incorporated into a framework with a built-in background panel and utilizing with multiple eyeglass frame supports.
Figure 3B:
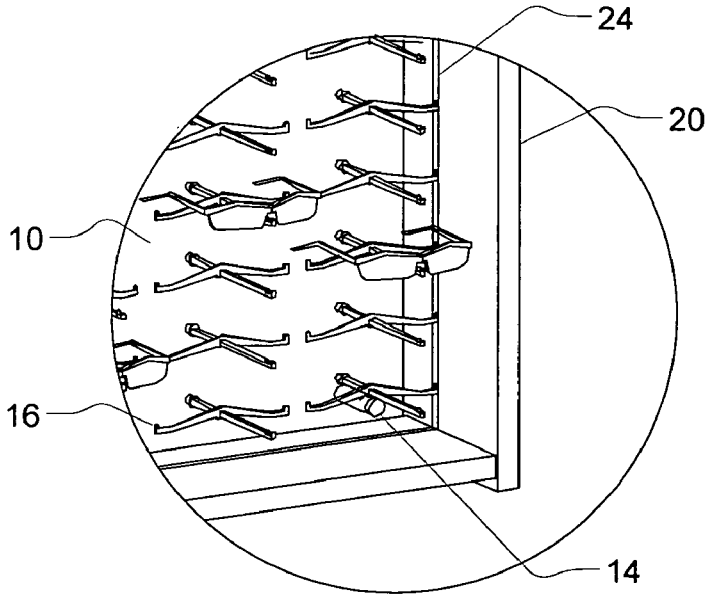

FIG. 3 shows an embodiment of the present invention where the background panel is built into the framework 20 of a display device that can be wall mounted or placed on a table or horizontal surface. This embodiment is shown in use with multiple eyeglass frame supports.

Figure 4A:
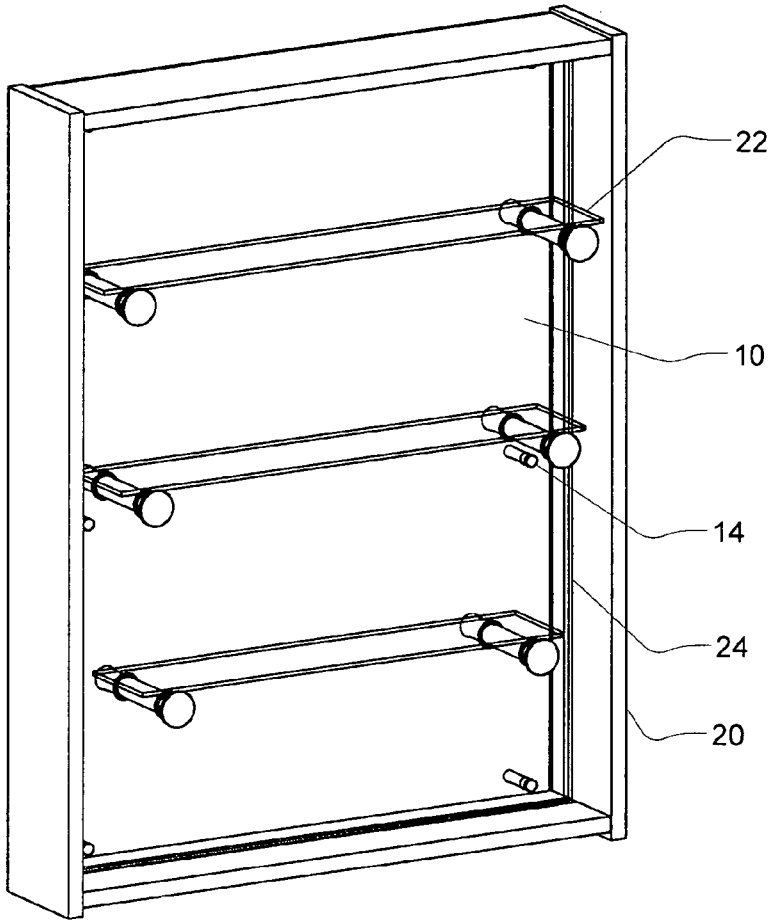
FIG. 4 is a perspective view of a display device incorporated into a framework with a built-in background panel and utilizing glass shelving to support the display items.
Figure 4B:
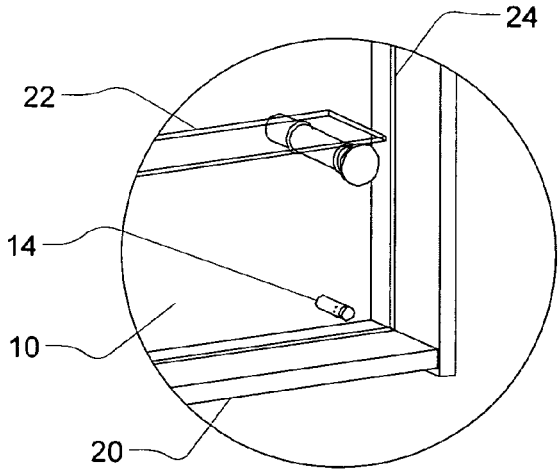

FIG. 4 is an embodiment of the present invention similar to the framework display model shown in FIG. 3. In the FIG. 4 embodiment however, glass shelves are utilized to hold the display items. This embodiment also utilizes stand-off mounts 14 to affix the translucent panel to the background panel.

Figure 5A:
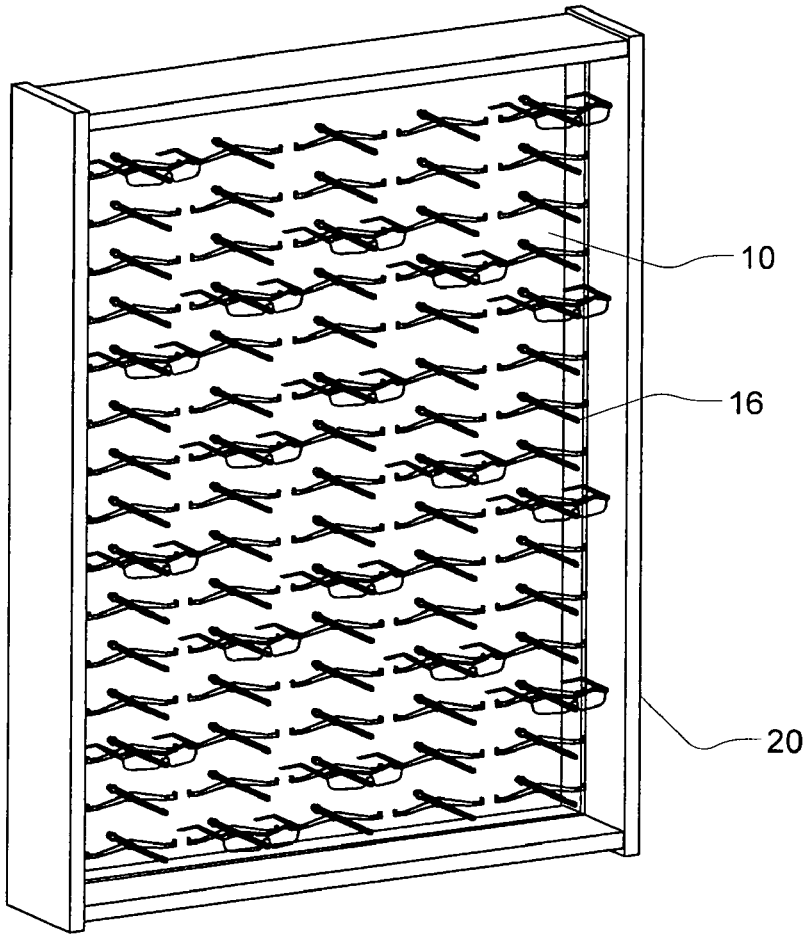
FIG. 5 is a perspective view of a display device incorporated into a framework without a built-in background panel and utilizing with multiple eyeglass frame supports.
Figure 5B:
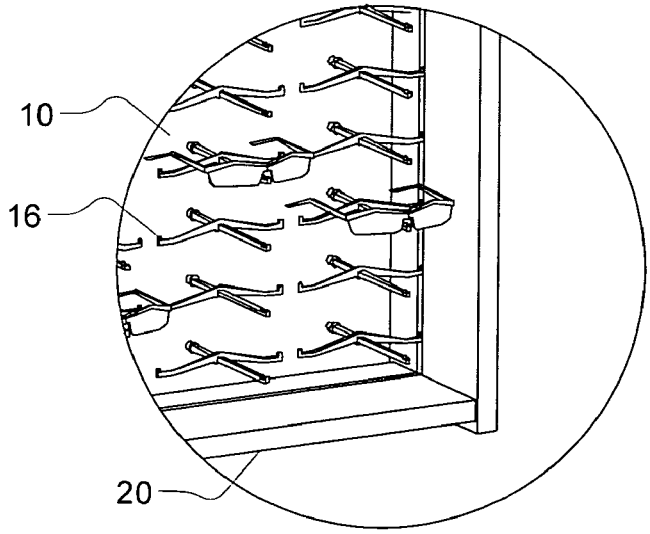

In the embodiment of the present invention shown in FIG. 5, the background panel is not built into the framework 20. In this embodiment, the opaque, background panel is supplied by the surface to which the framework is mounted or placed upon. This embodiment utilizes a floor or wall or other opaque surface as the background. The design of the framework allows the translucent panel to be placed at a predetermined distance from the back of the framework, and thus at the same predetermined distance from the opaque surface.

Figure 6A:
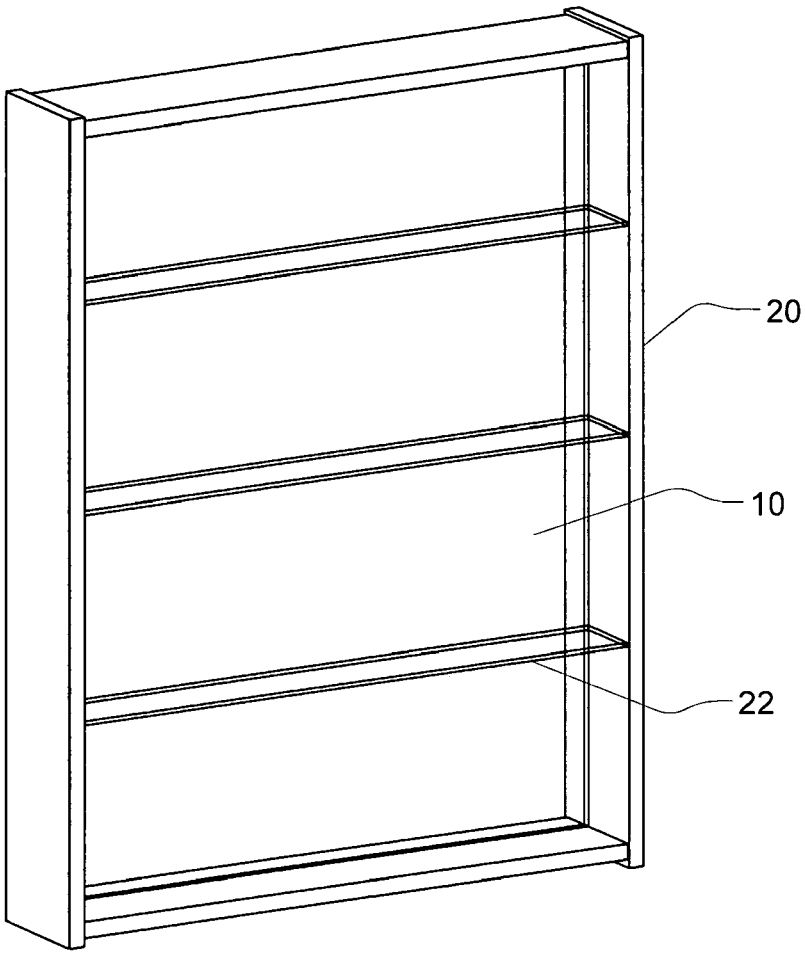
FIG. 6 is a perspective view of a display device incorporated into a framework without a built-in background panel and utilizing glass shelving to support the display items.
Figure 6B:
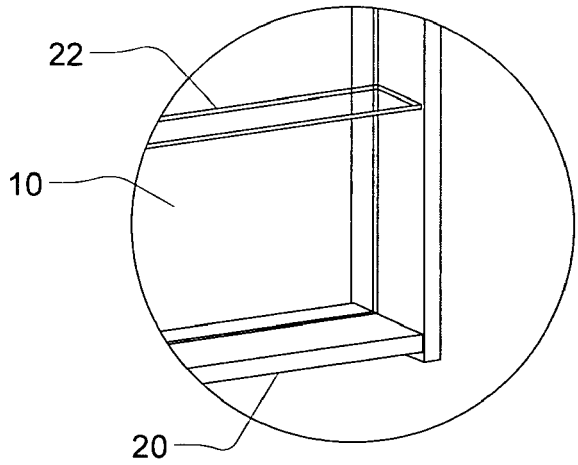

The embodiment of FIG. 6 also does not have a built in background panel. It is different from the embodiment of FIG. 5 in that it utilizes glass shelving to hold the display items. Otherwise, this display device incorporates the same display design as the FIG. 5 embodiment.

Figure 7A:
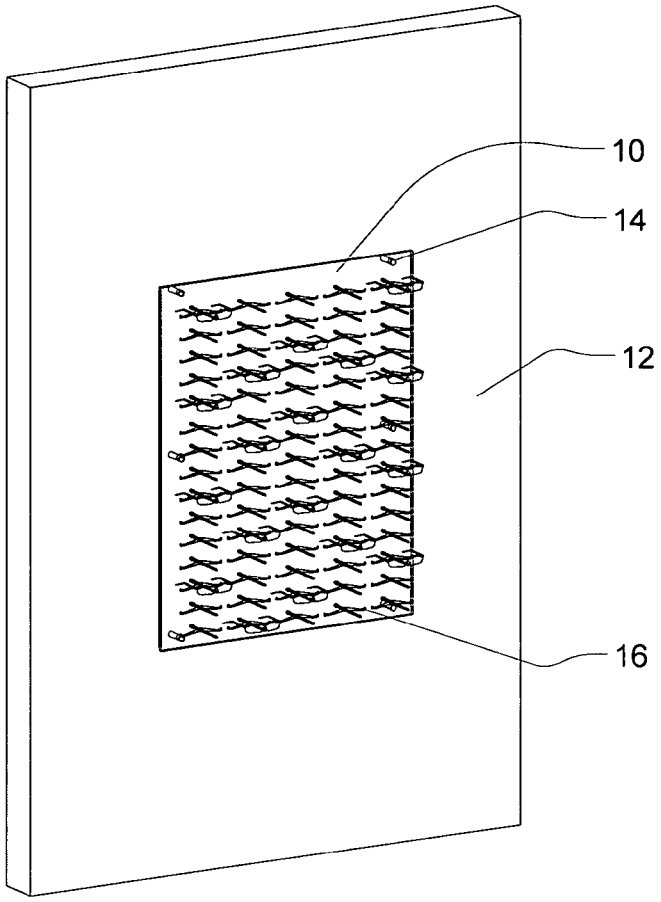
FIG. 7 is a perspective view of a display device consisting of a translucent panel with multiple eyeglass frame supports mounted to a wall.
Figure 7B:
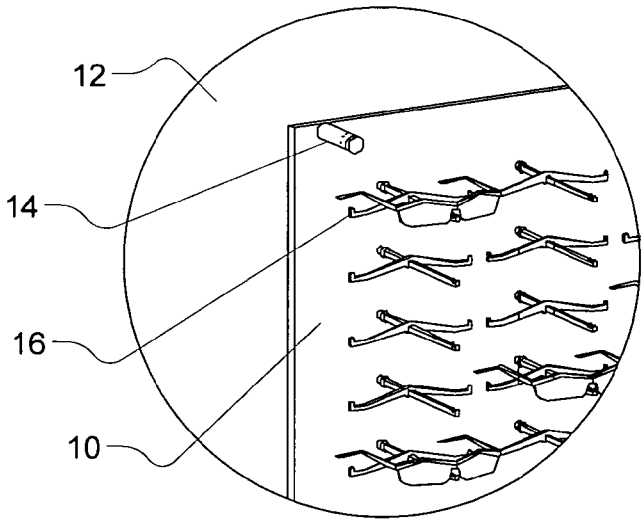

FIG. 7 illustrates an embodiment of the present invention that utilizes a translucent panel with eyeglass frame supports. The translucent panel is mounted to a wall and the wall acts as the background panel/surface. Stand-off mounts act to position the translucent panel at a predetermined distance from the wall to which it is mounted. This embodiment dispenses with the framework of the display devices shown in previous embodiments. Advantages to this embodiment include reduced material expense, greater flexibility of mounting location due to reduced space requirement and use of natural lighting or artificial lighting not part of the display device.

Figure 8A:
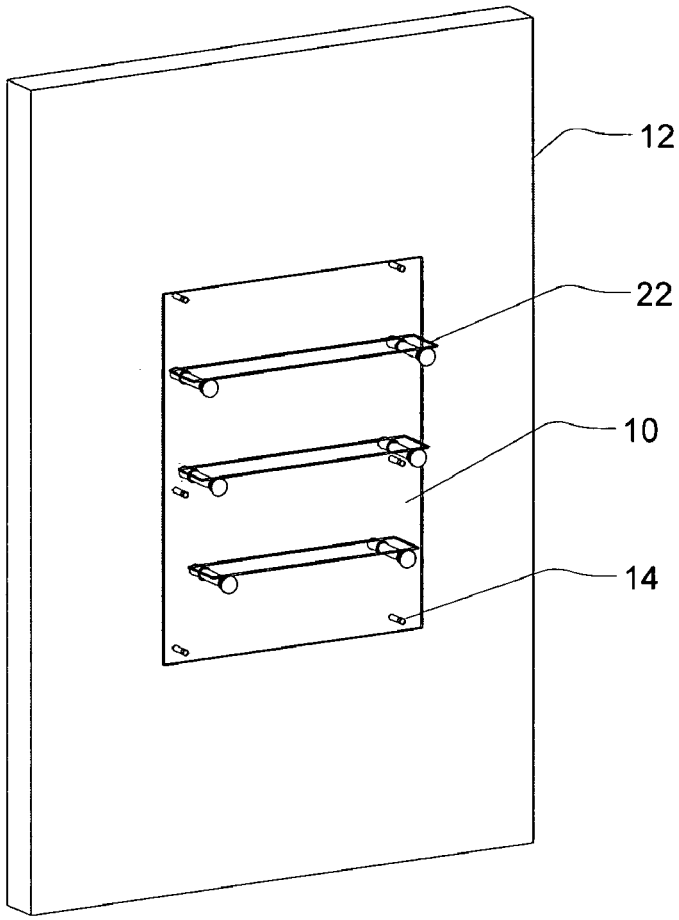
FIG. 8 is a perspective view of a display device consisting of a translucent panel with glass shelving mounted to a wall.
Figure 8B:
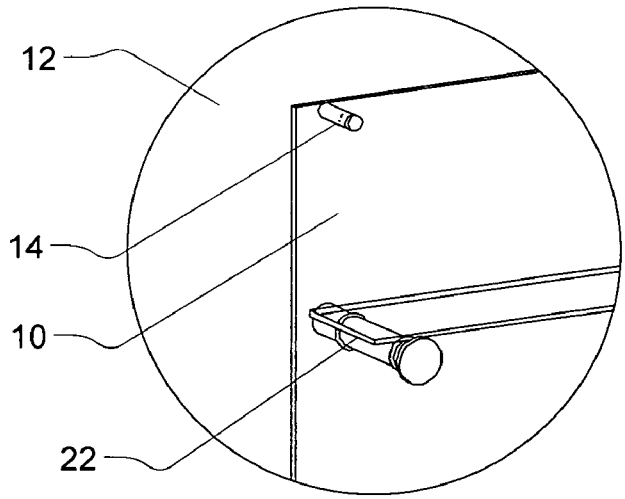

The embodiment in FIG. 8 encompasses the same design as the FIG. 7 embodiment except that glass shelves are utilized to hold the display items. This embodiment also possesses the same advantages as discussed above in the FIG. 7 description.

Figure 9A:
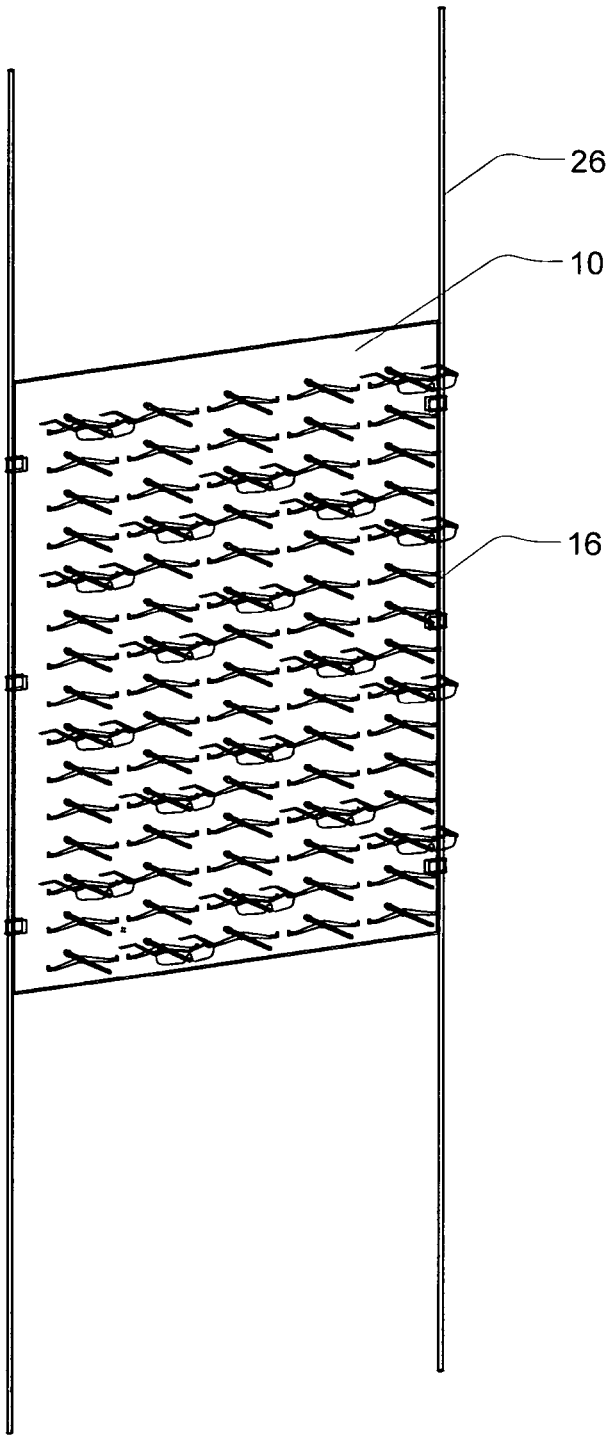
FIG. 9 is a perspective view of a display device consisting of a translucent panel with multiple eyeglass frame supports mounted to cables.
Figure 9B:
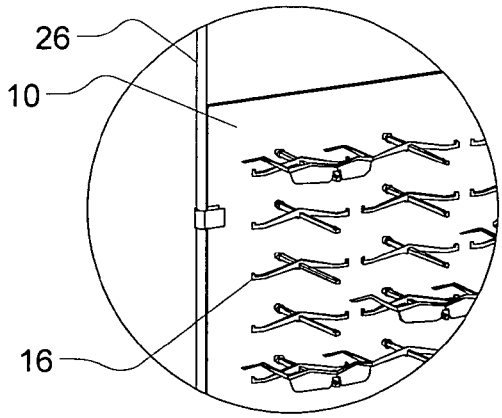

FIG. 9 shows an embodiment of the present invention that incorporate a translucent panel mounted to support cables. The cables can be attached to ceiling supports or horizontal wall supports so that translucent panel is positioned at a predetermined distance from an opaque, background surface. Stand-off mounts or similar positioning devices could be used to assure that there is a defined separation between the translucent panel and the opaque, background surface. This embodiment is shown in use with multiple eyeglass frame supports.

Figure 10A:
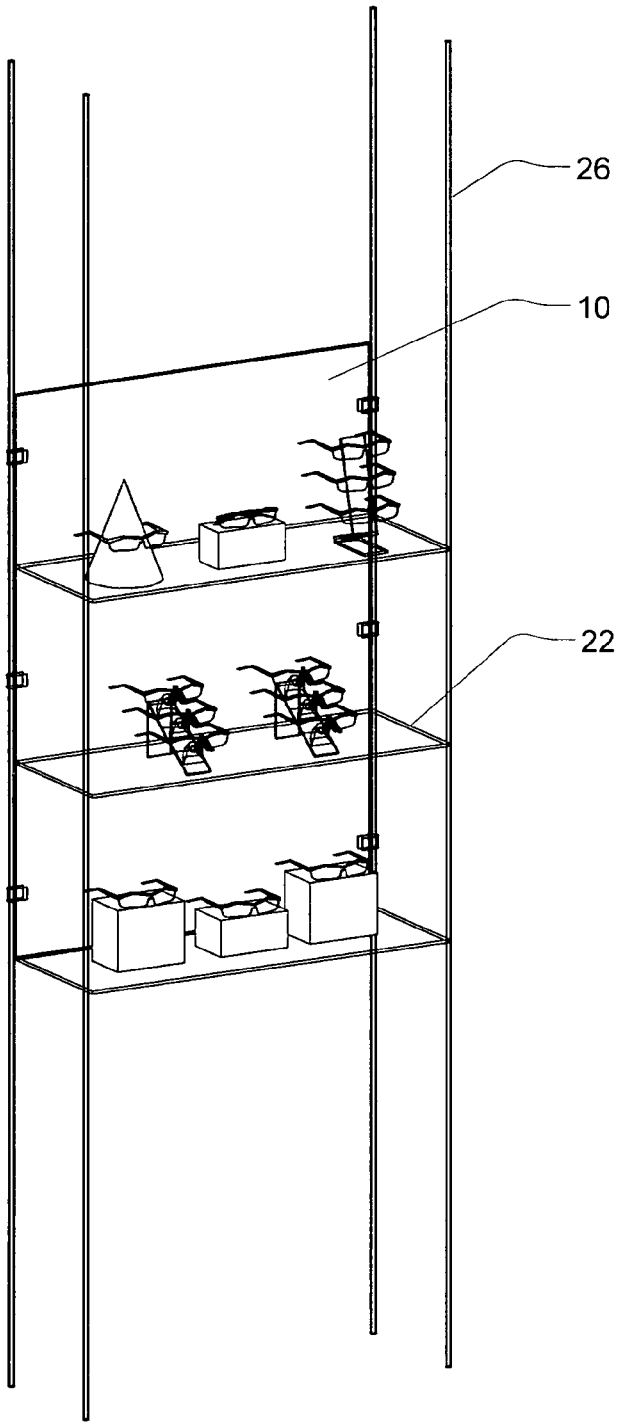
FIG. 10 is a perspective view of a display device consisting of a translucent panel with glass shelving mounted to cables.
Figure 10B:
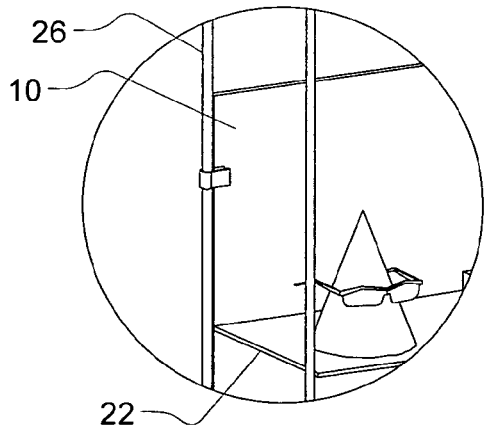
Figure 11:
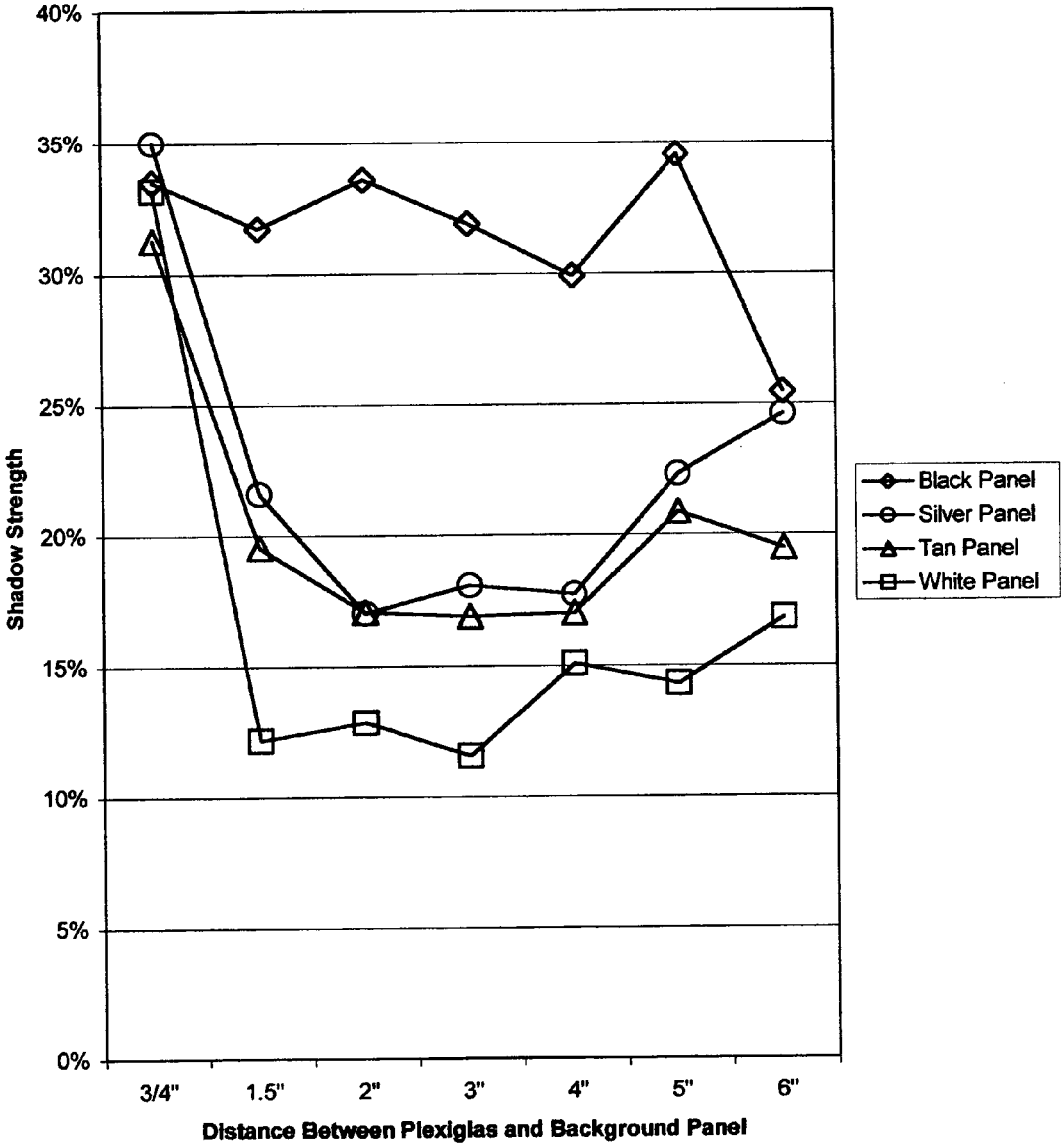
FIG. 11 is a graph of the data illustrating the effect of 1) the color of the opaque, background panel and 2) the spacing between the translucent panel and the opaque, background panel on the shadows cast by the display items or support devices.

FIG. 10 illustrates another embodiment utilizing support cables and a translucent panel. Here, the cables support glass display shelves in addition to the translucent panel. As indicated in the FIG. 9 description above, stand-off mounts or similar positioning devices could be used to assure that there is a defined separation between the translucent panel and the opaque, background surface. The cables can be attached to ceiling supports or horizontal wall supports so that the translucent panel is positioned at a predetermined distance from an opaque, background surface.

Quantification of Results

An experiment was designed to quantify the effectiveness of the display device in reducing the shadows cast on the translucent panel. A display device similar to the one shown in FIG. 1 was set up with various slots (grooves) made to hold a translucent panel and the background panel in place (in lieu of the standoff mounts shown in FIG. 1). The slots allowed the experimenter to easily adjust the placement of the background panel with respect to the translucent panel to quantify the relationship between panel separation (i.e., distance between panels) and shadow reduction. Slots were placed in the display devices so that the panels could be separated by the following seven distances as shown in Table 1:

TABLE 1

| | Measured Distance Between Panels During Testing | | | | | | |
|---|---|---|---|---|---|---|---|
| | 1 | 2 | 3 | 4 | 5 | 6 | 7 |
| Inches | .75" | 1.5" | 2" | 3" | 4" | 5" | 6" |
| mm | 19.1 | 38.1 | 50.8 | 76.2 | 101.6 | 127.0 | 152.4 |

The tester first measured the effect of panel separation by using a white background panel spaced 0.75 inches (19.1 mm) behind the translucent panel. The display apparatus utilized for testing purposes was similar to the display shown in FIG. 1A with two overhead lights.

A GE Type 217 Light Meter was used to take the light readings. The Type 217 light meter is a pocket size, color and cosin-corrected, three-scale meter capable of directly reading illuminance from 10 to 1,000 footcandles. The light meter was first used to measure (in footcandles) the light incident on the translucent panel in three different areas: 1) top of the of panel, 2) middle of the panel and 3) bottom of panel. These first three measurements were taken directly under one of the lights and the results were tabulated. A piece of cardboard was then used to create a shadow and a light meter reading was taken in the same three areas (top, middle and bottom of translucent panel) to compare the light meter readings for the "shadow area".

The results from these measurements are shown in Table 2 in the "Under Light" column. The light meter readings are naturally highest at the top of the panel due to the close proximity to the light source. The test was then repeated with the measurements taken between the two light sources and at the same relative positions from the light source. These results are also shown in Table 2 for comparison purposes in the "Between Lights" column. Table 2 reflects the data obtained with the panels separated by 0.75 inches (17.4 mm).

TABLE 2

Test Measurements Under/Between Lights (White Background Panel)

| Distance Between Panels .75" (17.4 mm) | Under Light (footcandles) | Between Lights (footcandles) |
|---|---|---|
| Top/Light | 48 | 34 |
| Top/Shadow | 26 | 26 |
| Center/Light | 32 | 28 |
| Center/Shadow | 22 | 22 |
| Bottom/Light | 28 | 28 |
| Bottom/Shadow | 16 | 16 |

Table 3 shows the data for the measurements taken on the translucent panel with the white background panel spaced from 0.75 inches (17.4 mm) to 6 inches (152 mm) behind the translucent panel. All of these readings were taken directly under the light as previously described.

TABLE 3

Test Measurements Directly Under One Light With Various Distances Between Translucent Panel & White Background Panel (in./mm)

| | Readings (foot candles) | | | | | | |
|---|---|---|---|---|---|---|---|
| | .75/19.1 | 1.5/38.1 | 2/50.8 | 3/72.6 | 4/102 | 5/127 | 6/152 |
| Top/Light | 48 | 42 | 44 | 46 | 40 | 38 | 38 |
| Top/Shadow | 26 | 42 | 38 | 44 | 38 | 36 | 36 |
| Center/Light | 32 | 30 | 30 | 28 | 28 | 32 | 30 |
| Center/Shadow | 22 | 26 | 24 | 24 | 24 | 28 | 28 |
| Bottom/Light | 28 | 24 | 20 | 24 | 26 | 26 | 26 |
| Bottom/Shadow | 16 | 16 | 16 | 18 | 20 | 20 | 20 |

Table 4 shows the measurements taken for the same display setup as utilized in obtaining the data in Table 3 but with the readings taken between the lights instead of directly below one light.

TABLE 4

Test Measurements Between The Two Lights With Various Distances Between Translucent Panel & White Background Panel (in./mm)

| | Readings (foot candles) | | | | | | |
|---|---|---|---|---|---|---|---|
| | .75/19.1 | 1.5/38.1 | 2/50.8 | 3/72.6 | 4/102 | 5/127 | 6/152 |
| Top/Light | 34 | 25 | 33 | 33 | 38 | 40 | 40 |
| Top/Shadow | 26 | 22 | 30 | 30 | 32 | 34 | 34 |

TABLE 4-continued

Test Measurements Between The Two Lights With Various Distances Between Translucent Panel & White Background Panel (in./mm)

| | Readings (foot candles) | | | | | | |
|---|---|---|---|---|---|---|---|
| | .75/19.1 | 1.5/38.1 | 2/50.8 | 3/72.6 | 4/102 | 5/127 | 6/152 |
| Center/Light | 28 | 23 | 28 | 28 | 30 | 30 | 30 |
| Center/Shadow | 22 | 20 | 26 | 26 | 26 | 26 | 22 |
| Bottom/Light | 28 | 20 | 20 | 22 | 24 | 23 | 30 |
| Bottom/Shadow | 19 | 18 | 18 | 18 | 18 | 18 | 21 |

The tests were then repeated to quantify the effects of the color of the background panel on the shadows cast on the translucent panel. Three additional colored panels were chosen and tested: black, silver and tan. The complete results from these tests are shown in the tables 5 and 6. Table 5 shows the results from measurements taken directly below one of the lights and Table 6 contains readings taken between the lights.

TABLE 5

Test Measurements Directly Under One Light With Various Distances Between Translucent Panel & Different Background Panels (in./mm)

| | Readings (foot candles) | | | | | | |
|---|---|---|---|---|---|---|---|
| | .75/19.1 | 1.5/38.1 | 2/50.8 | 3/72.6 | 4/102 | 5/127 | 6/152 |
| SILVER | | | | | | | |
| Top/Light | 34 | 30 | 30 | 28 | 30 | 30 | 28 |
| Top/Shadow | 20 | 24 | 30 | 28 | 28 | 22 | 22 |
| Center/Light | 22 | 20 | 18 | 22 | 20 | 20 | 20 |
| Center/Shadow | 12 | 14 | 14 | 18 | 18 | 16 | 16 |
| Bottom/Light | 14 | 12 | 18 | 18 | 18 | 18 | 18 |
| Bottom/Shadow | 10 | 8 | 12 | 12 | 12 | 14 | 12 |
| TAN | | | | | | | |
| Top/Light | 34 | 40 | 36 | 36 | 32 | 32 | 32 |
| Top/Shadow | 18 | 32 | 34 | 32 | 32 | 28 | 28 |
| Center/Light | 26 | 26 | 24 | 26 | 26 | 26 | 22 |
| Center/Shadow | 20 | 20 | 20 | 22 | 22 | 20 | 18 |
| Bottom/Light | 20 | 20 | 18 | 18 | 20 | 20 | 20 |
| Bottom/Shadow | 12 | 14 | 14 | 14 | 14 | 14 | 14 |
| BLACK | | | | | | | |
| Top/Light | 20 | 18 | 17 | 22 | 22 | 22 | 22 |
| Top/Shadow | 16 | 13 | 12 | 14 | 16 | 14 | 18 |
| Center/Light | 18 | 12 | 13 | 14 | 16 | 18 | 18 |
| Center/Shadow | 12 | 8 | 9 | 10 | 12 | 12 | 12 |
| Bottom/Light | 12 | 8 | 9 | 12 | 12 | 14 | 14 |
| Bottom/Shadow | 6 | 5 | 6 | 8 | 8 | 8 | 10 |

TABLE 6

Test Measurements Between The Two Lights With Various Distances Between Translucent Panel & Different Background Panels (in./mm)

| | Readings (foot candles) | | | | | | |
|---|---|---|---|---|---|---|---|
| | .75/19.1 | 1.5/38.1 | 2/50.8 | 3/72.6 | 4/102 | 5/127 | 6/152 |
| SILVER | | | | | | | |
| Top/Light | 22 | 17 | 21 | 22 | 22 | 23 | 24 |
| Top/Shadow | 16 | 14 | 17 | 18 | 18 | 19 | 18 |
| Center/Light | 20 | 15 | 18 | 19 | 17 | 18 | 18 |

TABLE 6-continued

| Test Measurements Between The Two Lights With Various Distances Between Translucent Panel & Different Background Panels (in./mm) | Readings (foot candles) | | | | | | |
|---|---|---|---|---|---|---|---|
| | .75/ 19.1 | 1.5/ 38.1 | 2/50.8 | 3/72.6 | 4/102 | 5/127 | 6/152 |
| Center/Shadow | 14 | 13 | 15 | 15 | 14 | 15 | 14 |
| Bottom/Light | 18 | 14 | 14 | 15 | 14 | 16 | 18 |
| Bottom/Shadow | 12 | 11 | 11 | 11 | 10 | 11 | 13 |
| TAN | | | | | | | |
| Top/Light | 24 | 22 | 22 | 25 | 26 | 28 | 30 |
| Top/Shadow | 18 | 19 | 19 | 21 | 22 | 23 | 22 |
| Center/Light | 20 | 20 | 20 | 21 | 22 | 20 | 20 |
| Center/Shadow | 16 | 17 | 17 | 17 | 18 | 17 | 18 |
| Bottom/Light | 20 | 15 | 19 | 18 | 18 | 18 | 20 |
| Bottom/Shadow | 14 | 12 | 12 | 14 | 12 | 12 | 16 |
| BLACK | | | | | | | |
| Top/Light | 16 | 18 | 16 | 18 | 16 | 18 | 18 |
| Top/Shadow | 12 | 12 | 12 | 12 | 12 | 14 | 14 |
| Center/Light | 12 | 14 | 14 | 14 | 14 | 16 | 16 |
| Center/Shadow | 8 | 10 | 8 | 10 | 10 | 10 | 12 |
| Bottom/Light | 12 | 12 | 14 | 14 | 14 | 16 | 14 |
| Bottom/Shadow | 6 | 8 | 8 | 10 | 8 | 10 | 10 |

To summarize the results, the readings were categorized by whether they were a "light"reading or a "shadow" reading. All top, center and bottom readings were then averaged for all measurements taken under the light and between the lights. These are shown in Table 7 below. The next step was to quantify the overall effect of the different color background panels and the distance between panels on the shadow cast on the translucent panel.

The "shadow strength" was defined as the ratio of the (average light reading minus the average shadow reading) divided by the average light reading. This gives a general indication of the percent reduction in light due to the shadow. If a reading of 30 foot candles was taken at a spot either under a light or between the lights and a subsequent reading of 22 was taken after a shadow was cast at the same spot on the translucent panel, the "shadow strength" would be (30−22)/30=27%. The shadow reading indicates that the amount of light has been reduced by 27%. Thus the available light after the shadow was cast on the translucent panel was 73% of the non-shaded light. If a light reading of 30 foot candles was taken and a subsequent shadow reading of 26 foot candles taken, then the shadow strength would be (30−25)/30=17%. Here the shadow cast on the translucent panel resulted in 83% of the non-shaded light. Thus the "shadow strength" gives an indication of how much light has been reduced by the shadow. The larger the "shadow strength" percentage, the darker the shadow.

TABLE 7

| Average Test Measurements and Shadow Strength With Various Distances Between Translucent Panel & Different Background Panels (in./mm) | Readings (foot candles) | | | | | | |
|---|---|---|---|---|---|---|---|
| | .75/ 19.1 | 1.5/38.1 | 2/50.8 | 3/72.6 | 4/102 | 5/127 | 6/152 |
| White Light | 36.0 | 32.0 | 31.3 | 32.7 | 31.3 | 32.0 | 31.3 |
| White Shadow | 21.3 | 28.0 | 26.0 | 28.7 | 27.3 | 28.0 | 28.0 |
| White Shadow Strength | 41% | 13% | 17% | 12% | 13% | 13% | 11% |

TABLE 7-continued

| Average Test Measurements and Shadow Strength With Various Distances Between Translucent Panel & Different Background Panels (in./mm) | Readings (foot candles) | | | | | | |
|---|---|---|---|---|---|---|---|
| | .75/ 19.1 | 1.5/38.1 | 2/50.8 | 3/72.6 | 4/102 | 5/127 | 6/152 |
| Silver Light | 23.3 | 20.7 | 22.0 | 22.7 | 22.7 | 22.7 | 22.0 |
| Silver Shadow | 14.0 | 15.3 | 18.7 | 19.3 | 19.3 | 17.3 | 16.7 |
| Silver Shadow Strength | 40% | 26% | 15% | 15% | 15% | 24% | 24% |
| Tan Light | 26.7 | 28.7 | 26.0 | 26.7 | 26.0 | 26.0 | 24.7 |
| Tan Shadow | 16.7 | 22.0 | 22.7 | 22.7 | 22.7 | 20.7 | 20.0 |
| Tan Shadow Strength | 38% | 23% | 13% | 15% | 13% | 21% | 19% |
| Black Light | 16.7 | 12.7 | 13.0 | 16.0 | 16.7 | 18.0 | 18.0 |
| Black Shadow | 11.3 | 8.7 | 9.0 | 10.7 | 12.0 | 11.3 | 13.3 |
| Black Shadow Strength | 32% | 32% | 31% | 33% | 28% | 37% | 26% |

As mentioned previously, the purpose of this display device is to minimize the effect of the shadows cast on the translucent panel. Thus, the lower the shadow strength, the more effective the display device.

We claim:

1. A display device comprising:

an opaque surface or panel;

a translucent panel of approximately the same or less area than said opaque surface or panel, said translucent panel further comprised of frosted acrylic material which is frosted throughout the entire acrylic structure;

support means for affixing said translucent panel substantially parallel to said opaque surface or panel, such that said translucent panel is in front of or above said opaque surface or panel and at a predetermined distance between 1 and 185 millimeters (0.04 to 7.3 inches) from said opaque surface or panel.

2. The display device of claim 1 further comprising item support means affixed to said translucent panel to hold items for display.

3. The display device of claim 2 whereby said item support means contain support members for displaying eyewear.

4. The display device of claim 2 further comprising a light source on the display side of said translucent panel remote from the area between the translucent panel and opaque surface or panel.

5. The display device of claim 4 wherein said light source further comprises fastening and positioning means whereby display items positioned on said item support means are illuminated by said light source.

6. The display device of claim 5 wherein the distance between said translucent panel and said opaque surface or panel is between 31.8 millimeters (1.25 inches) and 88.9 millimeters (3.5 inches).

7. The display device of claim 6 wherein said translucent panel is affixed to said opaque surface or panel by a plurality of stand-off mounts.

8. The display device of claim 7 whereby said item support means contain support members for eyewear.

9. The display device of claim 4 wherein the distance between said translucent panel and said opaque surface or panel is between 31.8 millimeters (1.25 inches) and 88.9 millimeters (3.5 inches).

10. The display device of claim 9 wherein said translucent panel is affixed to said opaque surface or panel by a plurality of stand-off mounts.

11. The method of reducing the effect of shadows on items in display devices consisting of:

utilizing an opaque surface or panel;

positioning a translucent panel substantially parallel to said opaque surface or panel, such that the distance between said opaque surface or panel and said translucent panel is between 1 and 185 millimeters (0.04 to 7.3 inches), said translucent panel having a frosted acrylic structure throughout and of approximately the same or less area as said opaque surface or panel.

12. The method of claim 11 further including the step of providing item support means affixed to said translucent panel on the surface remote from the area between the translucent and opaque panels.

13. The method of claim 12 further including the step of providing a light source with fastening and positioning means whereby display items positioned on said item support means are illuminated by said light source.

14. The method of claim 13 further including the step of positioning said translucent panel substantially parallel to said opaque surface or panel, such that the distance between said opaque surface or panel and said translucent panel is between 31.8 millimeters (1.25 inches) and 88.9 millimeters (3.5 inches).

15. The method of claim 14 further including the step of adapting said item support means to contain support members for displaying evewear.

* * * * *